US008056634B2

(12) United States Patent
Spencer

(10) Patent No.: US 8,056,634 B2
(45) Date of Patent: Nov. 15, 2011

(54) OFF-CENTER RUNNING TOOL FOR SUBSEA TREE

(76) Inventor: David N. Spencer, Aberdeen (GB)

( * ) Notice: Subject to any disclaimer, the term of this patent is extended or adjusted under 35 U.S.C. 154(b) by 353 days.

(21) Appl. No.: 12/102,507

(22) Filed: Apr. 14, 2008

(65) Prior Publication Data

US 2009/0255681 A1 Oct. 15, 2009

(51) Int. Cl.
*E21B 23/00* (2006.01)

(52) U.S. Cl. ..... 166/341; 166/336; 166/339; 166/344; 166/351; 166/368; 166/311

(58) Field of Classification Search ..... 166/341, 166/336–339, 342, 344, 351, 352, 368, 250.01, 166/381; 405/154.1, 158
See application file for complete search history.

(56) References Cited

U.S. PATENT DOCUMENTS

| | | | | |
|---|---|---|---|---|
| 4,058,162 | A * | 11/1977 | Smith | 166/124 |
| 4,167,215 | A * | 9/1979 | Thorne | 166/341 |
| 4,214,842 | A * | 7/1980 | Franks | 405/191 |
| 4,375,237 | A * | 3/1983 | Churchman | 166/117.5 |
| 4,442,892 | A * | 4/1984 | Delesandri | 166/85.1 |
| 4,508,165 | A * | 4/1985 | Foust | 166/117.5 |
| 4,732,215 | A * | 3/1988 | Hopper | 166/366 |
| 4,846,271 | A * | 7/1989 | Delesandri | 166/78.1 |
| 5,092,399 | A * | 3/1992 | Lang | 166/77.53 |
| 5,320,175 | A * | 6/1994 | Ritter et al. | 166/339 |
| 5,791,418 | A * | 8/1998 | Milberger et al. | 166/368 |
| 5,806,589 | A * | 9/1998 | Lang | 166/77.53 |
| 6,003,602 | A * | 12/1999 | Wilkins | 166/339 |
| 6,244,359 | B1 * | 6/2001 | Bridges et al. | 175/5 |
| 6,581,691 | B1 | 6/2003 | Jennings et al. | |
| 6,725,924 | B2 * | 4/2004 | Davidson et al. | 166/250.01 |
| 6,966,381 | B2 * | 11/2005 | Stjernstrom et al. | 166/337 |
| 7,032,673 | B2 * | 4/2006 | Dezen et al. | 166/341 |
| 7,062,960 | B2 * | 6/2006 | Couren et al. | 73/152.51 |
| 7,225,877 | B2 * | 6/2007 | Yater | 166/344 |
| 7,281,451 | B2 * | 10/2007 | Schulze Beckinghausen | 81/57.34 |
| 7,422,066 | B2 * | 9/2008 | Rodrigues et al. | 166/341 |
| 7,647,973 | B2 * | 1/2010 | Minassian et al. | 166/338 |
| 2003/0051879 | A1 | 3/2003 | Azancot | |
| 2004/0159439 | A1 | 8/2004 | Fenton et al. | |
| 2004/0262010 | A1 | 12/2004 | Milberger | |
| 2006/0191680 | A1 * | 8/2006 | Nelson | 166/208 |
| 2008/0017383 | A1 * | 1/2008 | Minassian et al. | 166/338 |

FOREIGN PATENT DOCUMENTS

| | | |
|---|---|---|
| GB | 2292573 A | 2/1996 |
| GB | 2370296 B | 6/2002 |

OTHER PUBLICATIONS

Combine Search and Examination Report, Application No. GB0906546.7, dated Jul. 30, 2009.

* cited by examiner

*Primary Examiner* — Thomas Beach
*Assistant Examiner* — Matthew Buck
(74) *Attorney, Agent, or Firm* — Bracewell & Giuliani LLP

(57) ABSTRACT

A running tool for lowering a christmas tree to a subsea wellhead. The running tool includes an off center adjustment to compensate for asymmetric weight distribution in the christmas tree. The running tool comprises a main body, latches for coupling the body to the christmas tree, an offset arm connected to the body, and a lift arm (drill pipe adaptor) connected to the lift arm and selectively positioned on the lift arm to offset and compensate for the christmas tree asymmetric weight distribution.

18 Claims, 7 Drawing Sheets

OFF-CENTER RUNNING TOOL FOR SUBSEA TREE

BACKGROUND

1. Field of Invention

The device described herein relates generally to the production of oil and gas. More specifically, the device described herein relates to a running tool with an off center attachment compensating for asymmetric christmas trees.

2. Description of Related Art

Subsea wellhead assemblies are typically used in the production of hydrocarbons extracted from subterranean formations below the seafloor. Subsea wellhead assemblies generally comprise a wellhead housing attached at a wellbore opening, where the wellbore extends through one or more hydrocarbon producing formations. Casing and tubing hangers are landed within the housing for supporting casing and production tubing inserted into the wellbore. The casing lines the wellbore, thereby isolating the wellbore from the surrounding formation. Tubing typically lies concentric within the casing and provides a conduit for producing the hydrocarbons entrained within the formation. Wellhead assemblies also typically include christmas trees connecting to the upper end of the wellhead housing. The christmas trees control and distribute the fluids produced from the wellbore.

The christmas trees are installed onto the wellhead housing by latching a running tool within the tree's main annulus and attaching wire or drill pipe to the running tool for lowering subsea to the wellhead housing. Often the tree's center of gravity is not coincident with the annulus axis; which if uncorrected causes the tree to tilt to prevent properly landing the tree onto the wellhead housing. The asymmetric tree can be balanced with added weights, but weight balancing is limited by the lowering wire and drill pipe structural limits. Additionally, christmas trees are becoming more complex and heavier thereby making weight balancing less desirable. This is exacerbated by subsea well operator using older rigs to install the newer larger and heavier tree systems. As a result the rigs experience difficulty while transferring the trees from supply vessels to the rig.

SUMMARY OF INVENTION

The present disclosure includes a running tool for raising and/or lowering a subsea wellhead member. The running tool may include a tool body having an axis, a latch on the tool body, an offset member attached to the tool body, and a lift arm affixed to the offset member. The lift arm can be selectively offset some distance from the tool axis to accommodate for an asymmetric weight distribution in the subsea wellhead member. The running tool may further comprising a profile on the latch formed for mating engagement with a profile in a bore of the subsea wellhead member. In one embodiment the subsea wellhead member is a christmas tree. The running tool can be lowered on a drill string or a wire connected to the top of the lift arm. The running tool can optionally include a subsea wellhead member pressure testing system. The pressure can be included in an extension disposed on the body bottom and flow nozzles formed on the extension in selective fluid communication with a pressurized fluid source. The pressurized fluid source can communicate to the nozzles via a passage, a fluid line, the lift arm, and drill pipe, where the passage is formed in the body, the fluid line connects the passage to an annulus in the lift arm, and the lift arm annulus openly communicates to an annulus in the drill pipe. The offset member can be an elongate element with its elongate side disposed substantially perpendicular to the body axis.

Multiple lift arm attachment locations can be formed along the offset member elongate side.

Also disclosed herein is a running tool for subsea attachment to a subsea wellhead member, the tool comprising, a tool body configured for insertion into a main bore of the subsea wellhead member, the tool body having an axis aligned with the bore axis, a subsea wellhead member latching device attached to the tool body, an elongate offset member attached to the tool body and oriented with its elongate side substantially perpendicular to the tool body axis, and a lift arm mechanically coupled to the offset member selectively positioned along the elongate side of the member based on the center of gravity of the running tool and the subsea wellhead member.

Also included herein is a method of handling a subsea wellhead member, the method includes providing a running tool having a body with an axis, a wellhead member latch on the body, an offset member attached to the body, and a lift arm attached to the offset member, estimating an offset distance from the tool body axis to where the lift arm is attached to the offset member, where attaching the lift arm an offset distance from the tool body axis compensates for asymmetric weight distribution of the subsea wellhead member about its axis, selectively positioning the lift arm on the offset member a distance away from the axis substantially equal to the offset difference, attaching the running tool to the subsea wellhead member, and manipulating the running tool thereby moving the subsea wellhead member with respect to a subsea well to conduct a subsea wellbore operation. The running tool may further comprise a pressure testing system, the method further comprising pressure testing the subsea wellhead member with the pressure testing system. The method can further include deploying a remotely operated vehicle (ROV) proximate to the running tool, and applying pressurized hydraulic fluid to the running tool from the ROV for activating the wellhead member latch.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Disclosed herein is a running tool used in handling subsea wellhead members while submerged subsea, from above the sea surface to the sea floor, or from the sea floor to the sea surface. For the purposes of discussion herein, subsea wellhead members include any wellhead component or any component deployed subsea. Examples include wellbore christmas trees, manifolds, separation devices, and other devices used in subsea hydrocarbon production. The running tool employs an offset compensating for an unequal weight distribution around a subsea wellhead member axis. The offset distance is selectable and can vary based upon the weight distribution of the subsea wellhead member being handled by the running tool.

Figure 1:
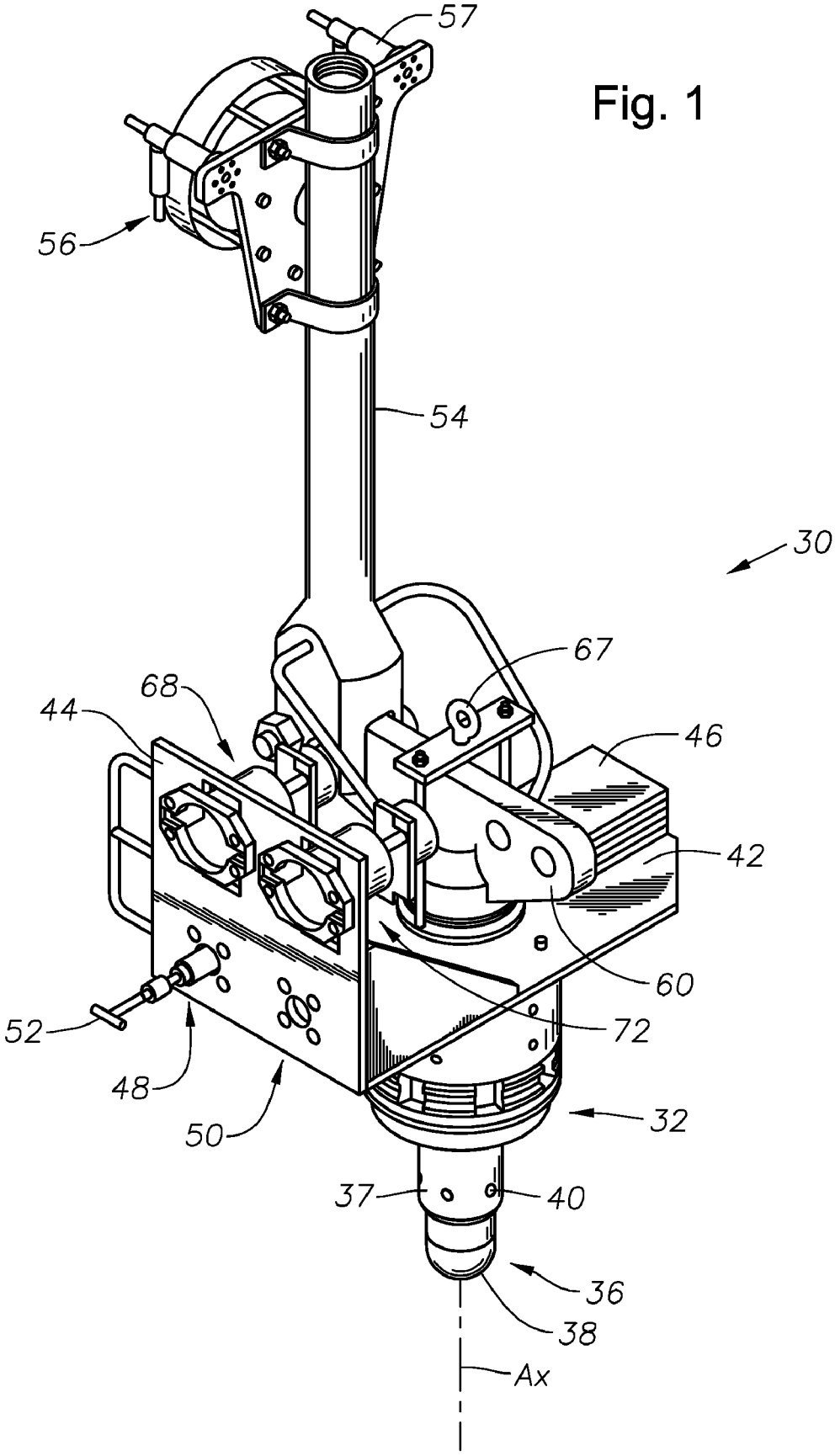
FIG. 1 is a side perspective view of an embodiment of an off center running tool.

With reference now to FIG. 1, a perspective view of a front side of an embodiment of a running tool assembly 30 is provided. The running tool 30 comprises a main body 32, a tool alignment extension 38 downwardly depending from the body 32 lower surface, an offset arm 60 attached on the upper end of the body 32, and a lift arm 54 (drill string adapter). The tool body 32 as shown is a substantially cylindrical member and configured for insertion into the main bore of a subsea wellhead member. Latching dogs 34 are provided circumferentially around a portion on the lower end of the body 32. The latching dogs 34 are profiled on their outer surface for mating engagement with similar correspondingly profiled surfaces on the inner circumference of the main bore of a subsea wellhead member.

The tool alignment extension 36 comprises a substantially cylindrical main body 37 attached to the lower end of the tool body 32 and an extension tip 38 on the lower end of the cylindrical body 37. Nozzles 40 are shown formed through the outer radial surface of the cylindrical main body 37. As will be discussed in more detail below, the nozzles 40 provide a cleaning and pressurizing function. The lower end of the tip 38 is hemispherically formed for guiding the tool body 32 into the main bore of a subsea wellhead member.

A substantially planer base plate 42 is attached to the upper portion of the tool body 32 and extends largely perpendicular to the tool axis $A_X$. Extending upward from one end of the base plate 42 is a remote operated vehicle (ROV) panel 44. On the panel 44 are hydraulic connections for supplying hydraulic fluid to the running tool assembly 30. The hydraulic fluid may be pressurized and supplied by an ROV. Also included with the panel 44 are valves actuatable by the ROV, the valves control hydraulic fluid flow to the running tool assembly 30 via the hydraulic connections. More specifically, a hot stab receptacle 48 is disposed on a lower end of the panel 44. Adjacent the hot stab receptacle 48 is a parking receptacle 50. In the embodiment of FIG. 1 a T-handle 52 is temporarily inserted into the hot stab receptacle 48. As is known, the T-handle 52 is removable from the hot stab receptacle 48 by the ROV to allow a hydraulic line connection in the hot stab receptacle 48. While a hydraulic line is connected into the hot stab receptacle 48, the T-handle 52 can be parked in the parking receptacle 50.

The valves on the upper portion of the panel comprise a lock valve assembly 68 and a release valve assembly 72. Manipulating the lock valve assembly 68 into the open position supplies pressurized hydraulic fluid to the latching dogs 34 for extending them into a locking position and attaching to the subsea wellhead member. Similarly, the dogs 34 can be unlatched or released by operating the release valve assembly 72 which bleeds the hydraulic fluid from the dogs 34. An optional release assembly 66 is provided with the tool assembly 30 extending upward from the base plate 42 onto risers on opposite sides of the offset arm 60; a connecting member connects to the terminal ends of the risers. An attachment ring 67 is provided on the connecting member and for connection and manipulation of the secondary release assembly 66.

Figure 5:
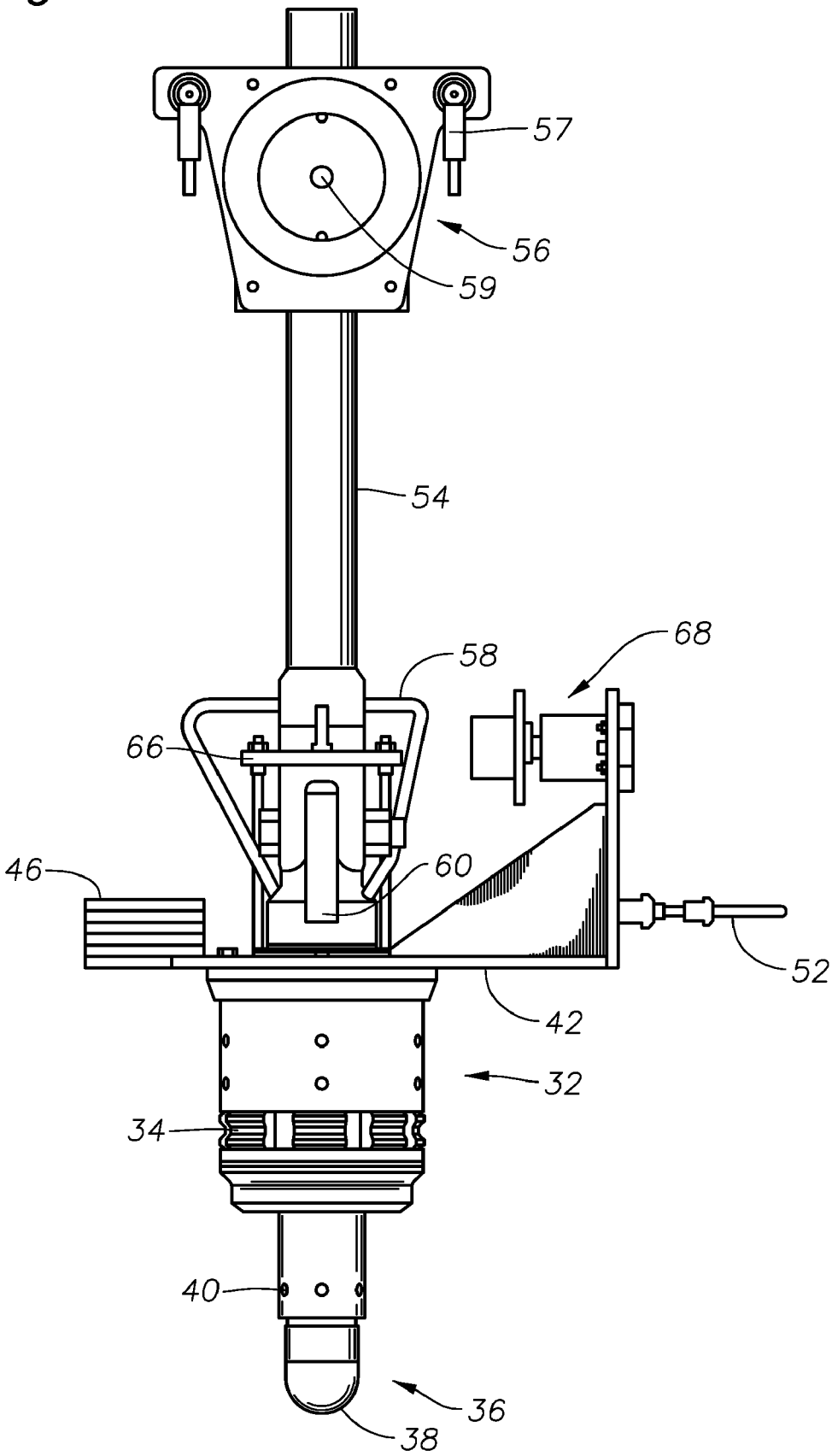
FIG. 5 is a side view of an embodiment of an off center running tool.

An optional parking plate 56 is bolted on the upper portion of the lift arm 54. The parking plate 56 includes an attachment 57 for connecting unused electrical lines that as a way of stowing them during use of the running tool assembly 30. Stowing unused lines or leads on the parking plate 56 secures the lines and prevents tangling of these lines and protects the lines or other equipment from potential damage. The parking plate 56 also includes a fixture 59 for attachment of a hydraulic line (FIG. 5).

Figure 2:
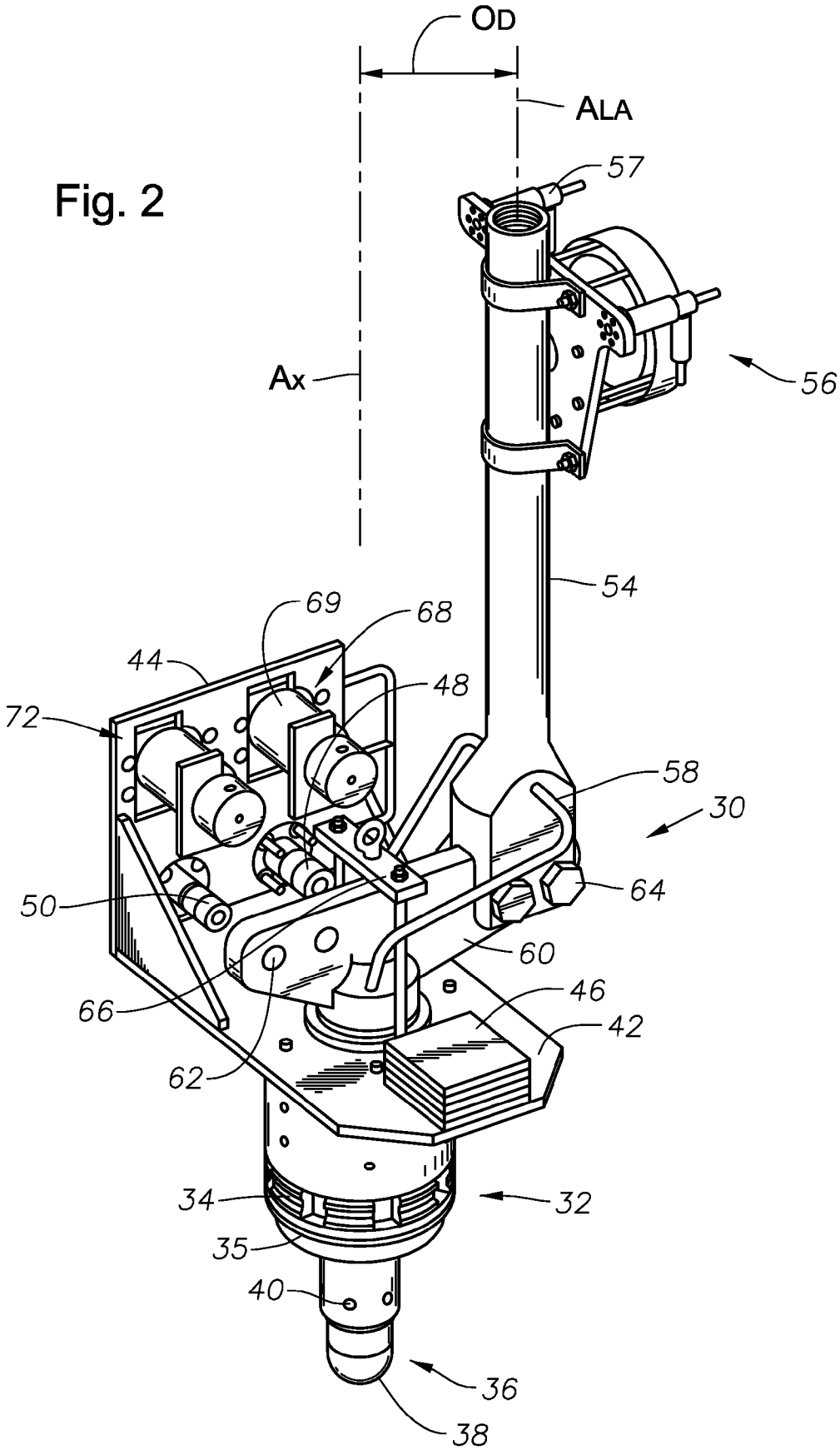
FIG. 2 is a side perspective view of an embodiment of an off center running tool.
Figure 7:
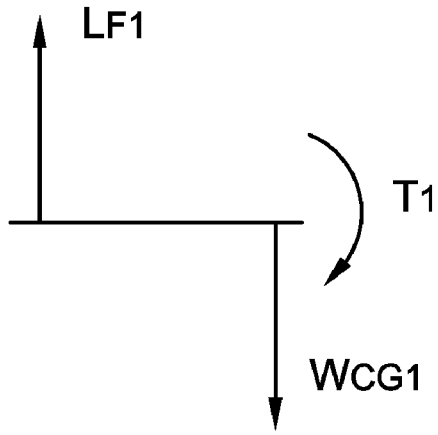
FIG. 7 schematically illustrates lift and weight forces and a resulting torque when lifting an asymmetric wellhead member.
Figure 8:
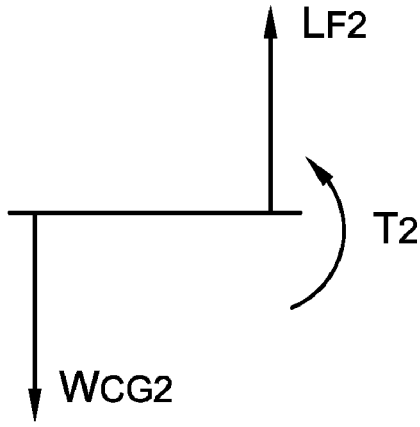
FIG. 8 schematically illustrates lift and weight forces and a resulting torque when lifting a running tool having an offset lift arm.

With reference now to FIG. 2, the lift arm 54 is shown attached to the offset arm 60 by bolts 64 extending through bolt holes 62 shown on the lower portion of the lift arm 54. The lift arm 54 is positioned laterally away from the tool body 32 wherein its axis $A_{LA}$ is an offset distance $O_D$ from the tool body 32 axis $A_X$. In one embodiment, the value of the offset distance $O_D$ is established to compensate for an asymmetric subsea wellhead member. In one embodiment, an asymmetric subsea wellhead member has an uneven weight distribution with respect to the point where the running tool attaches to the wellhead member. Thus the wellhead member center of gravity is off-center or laterally disposed from the running tool attachment point. For example, when attaching to a wellhead member within its main bore, the attachment point is considered to coincide with the axis of the main bore. FIG. 7 schematically depicts force vectors representing the subsea wellhead member weight $W_{CG1}$ and the lifting force $L_{F1}$ applied by the running tool onto the member. The vectors further illustrate an example of the distance between the applied lifting force and the center of gravity. Attaching to the main bore of an asymmetric subsea wellhead member produces a torque or moment arm on the running tool, as signified by the arrow $T_1$. FIG. 8 is a schematic comprising force vectors for lifting with a running tool having an offset lifting arm. Force vector $L_{F2}$ denotes the force to lift the running tool and force vector $W_{CG2}$ represents the running tool center of gravity. The distance between the force vectors represents the distance between the lift arm axis and running tool center of gravity. A torque or moment arm results as illustrated by arrow $T_2$.

Figure 9:
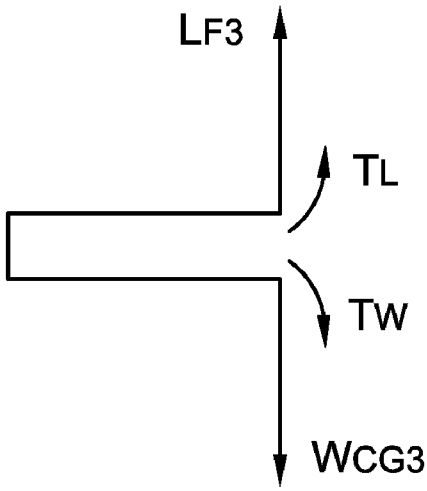
FIG. 9 schematically depicts lift and weight forces when lifting an asymmetric wellhead member with a running tool having an offset lift arm.

The subsea wellhead member center of gravity location can be calculated by various known means. Similarly, the location of the combined running tool assembly 30 with an attached subsea wellhead member center of gravity can also be calculated. Knowing the center of gravity location and associated weight, the offset distance $O_D$ can be calculated to compensate for the aforementioned asymmetric weight distribution. Accounting for or compensating for asymmetric loading creates a second moment arm counter to the moment arm formed between the attachment to the wellhead member bore and its center of gravity. These two moment arms are in opposite directions, and if in the same magnitude, the moment arms will cancel. This can remove weight distribution tilt and thus eliminating the need to add balancing weights. FIG. 9 schematically illustrates a lifting force vector $L_{F3}$, its resulting moment arm $T_L$, the combined weight force $W_{CG3}$ of the running tool and asymmetric wellhead member applied along the combination's center of gravity, and the moment arm $T_W$ between the weight and its lift point.

As noted above, the nozzles 40 on the cylindrical portion of the alignment extension 36 selectively discharge pressurized fluid. In one embodiment, the pressurized fluid is delivered to the running tool 30 from inside of an attached drill pipe and through the annulus of the lift arm 54. Fluid lines 58 are shown extending from the side of the lift arm 54 and to the upper portion of the body of the tool 32. Passages (not shown) are formed through the tool body and in fluid communication with the nozzles 40. Selectively delivering pressurized fluid to the nozzles 40 through this fluid supply system can be used for clearing debris from adjacent a subsea wellbore member prior to attaching the running tool assembly 30 to the member. The pressurized fluid can also pressurize the inner workings of a subsea wellbore member for pressure testing the member and confirming member seal integrity. The pressure testing feature of the running tool assembly 30 is not limited to asymmetrically loaded subsea members, but can be performed on any device deployed using the running tool assembly 30. Accordingly, the running tool assembly 30 can be used for handling subsea wellhead members that are substantially symmetric and do not require an offset. In this situation, the lift 54 would be attached along or proximate to the running tool assembly 30 center of gravity.

Figure 3:
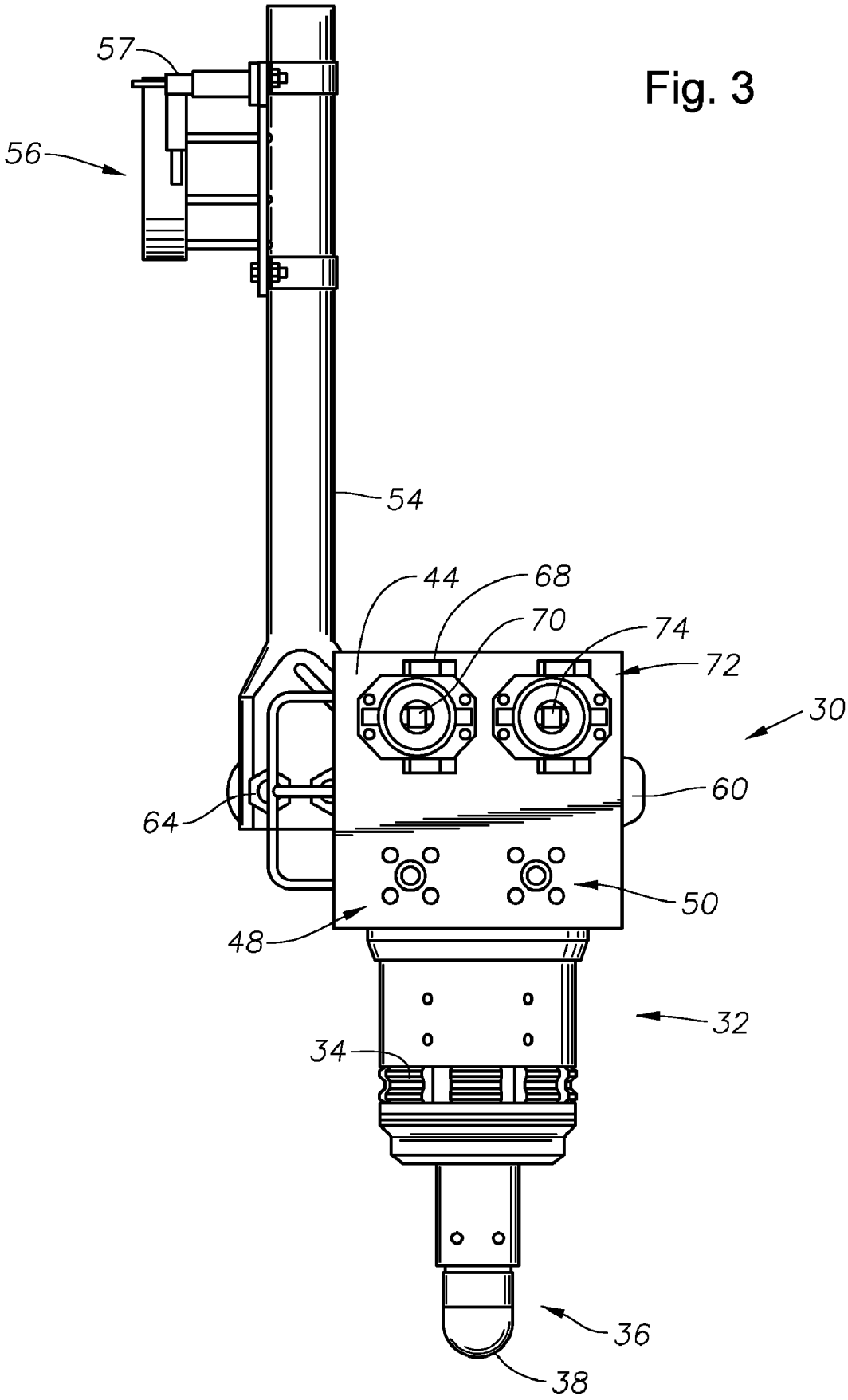
FIG. 3 is a side view of an embodiment of an off center running tool.
Figure 4:
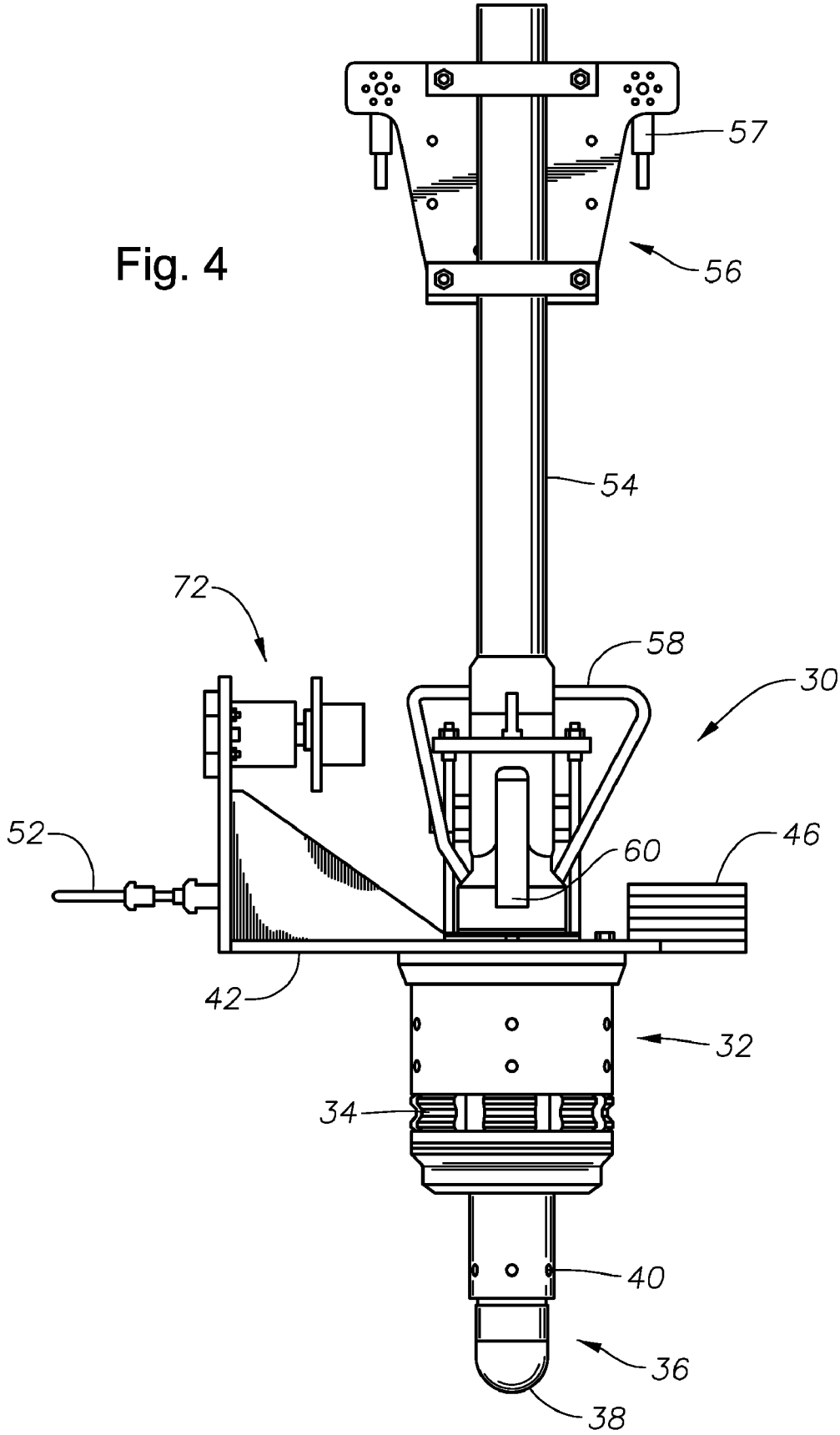
FIG. 4 is a side view of an embodiment of an off center running tool.

With reference now to FIG. 3, a full side view of an embodiment of the running tool assembly 30 is illustrated. This view displays the front of the lock valve assembly 68 and release valve assembly 72. More specifically, disposed within the lock valve assembly 68 is a lock valve actuator fitting 70 having a fitting profiled for manipulation manually or with an ROV. Similarly, the release valve assembly 72 includes a release valve actuator fitting 74 also profiled for manual or ROV manipulation. FIG. 4 is a rear view of an embodiment of the running tool assembly 30 depicting a side view of an example of the release valve assembly 72. Additionally, optional weights 46 are shown stacked on an edge of the face plate 42 to provide balancing of the running tool assembly 30.

Figure 6:
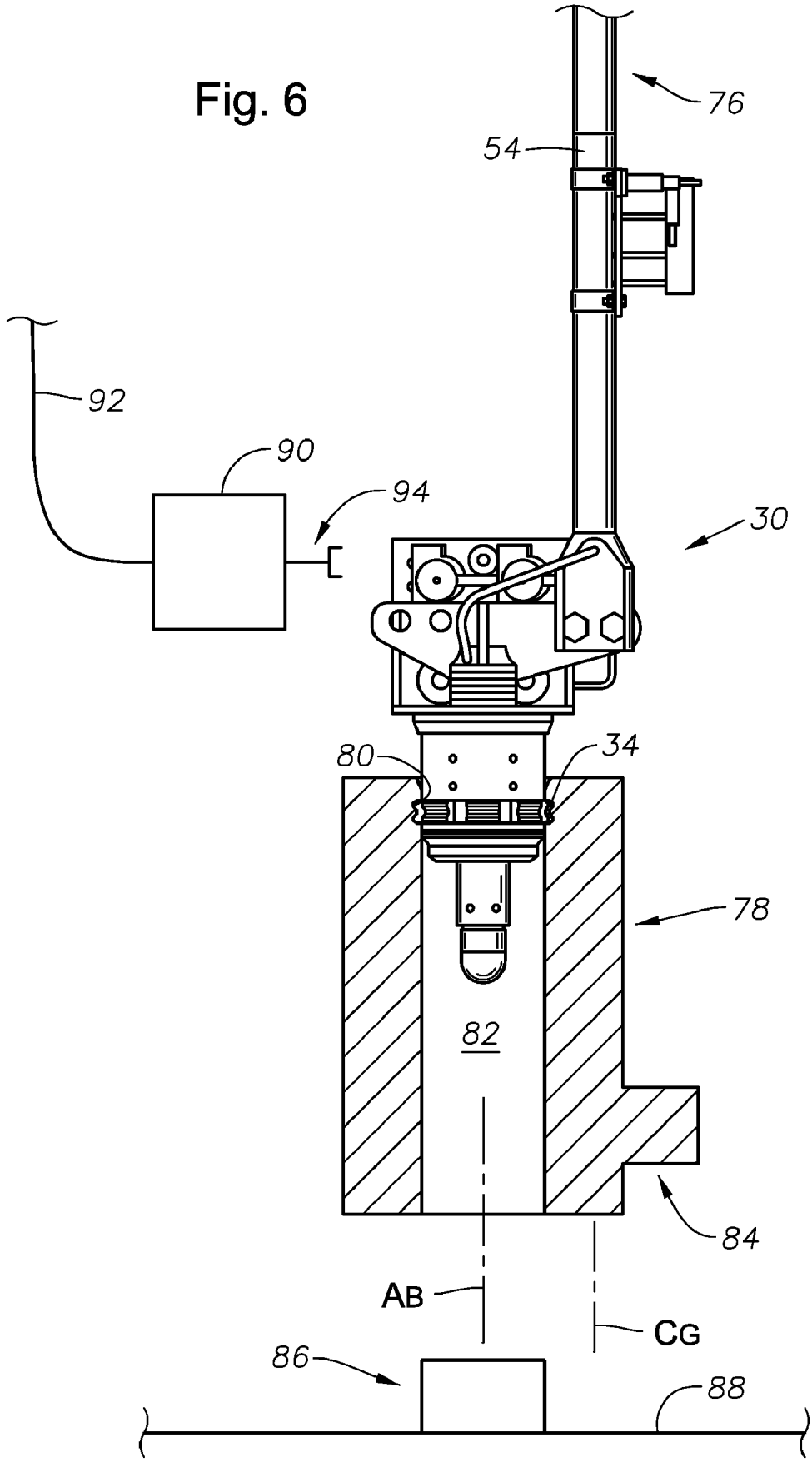
FIG. 6 is a side view of an embodiment of an off center running tool used for lowering a christmas tree subsea.

FIG. 6 provides in side view an example of deployment or handling of a subsea wellhead member using the running tool assembly 30 as described herein. In the embodiment shown, the subsea wellhead member comprises a christmas tree 78. The christmas tree 78 has a main bore 82 formed through the body of the tree 78. Dogs 34 on the running tool assembly 30 are shown extended outward into latching engagement with a profile 80 formed on the inner circumference at the bore 82. In this example of use, the running tool assembly 30 is attached to a drill string 76 on the upper end of the lift arm 54. The christmas tree 78 includes an offset element 84 on one side, thereby contributing to an asymmetric weight distribution that offsetts the tree 78 center of gravity from the bore axis $A_B$.

The lift arm has been selectively positioned at an offset distance from the axis of the bore $A_B$ to compensate for the asymmetric weight distribution. It should be pointed out that in this configuration the bore axis $A_B$ and the tool body axis $A_X$ substantially coincide. Selectively positioning the lift arm on the offset member 60 compensates for the tree 78 asymmetric weight distribution. The compensation eliminates christmas tree 78 tilting when being handled by the running tool assembly 30. Additionally, an ROV 90 is shown attached to a control line 92 and with an ROV arm 94 extending from the ROV 90. As is known, the ROV 90 can be used for manipulating the valve assemblies (68, 72) and delivering hydraulic flow through the hot stab 48. A wellhead 86 is shown below the tree 78 on a sea bed 88. Thus, the operation illustrated in FIG. 6 can comprise installation of the tree 78 on the remaining portions of the wellhead assembly, or removal of the tree for maintenance or repair of the tree 78. In the embodiment of FIG. 6, the axis of the lift line $A_{LA}$ is largely aligned with the center of gravity $C_G$ of the combination christmas tree 78 and running tool assembly 30.

In one optional mode of operation, the running tool assembly 30 can be secured within a subsea wellbore member, such as a christmas tree, during assembly of the wellbore member. This may be done with or without a choke module installed in the bore of the member. Accordingly, the running tool assembly 30 can be left on the wellhead member until assembly of the member is complete and after it has been installed on a subsea wellhead.

One of the many advantages provided by using the device described herein is reduction of counterweights, which eases the difficulty of older rigs handling heavier newer trees mentioned above. The reduced weight enhances rig safety and reduces the time required for landing operations.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims. For example, in one optional embodiment, the device could be operated by a surface manipulated umbilical without the need for a remotely operated vehicle.

What is claimed is:

1. A running tool for handling a subsea wellhead member, the running tool comprising:

a tool body having an axis, a fluid passage therethrough with an outlet on a lower portion of the body;

a latch on the tool body above the outlet, the latch having an engaged position for engagement with a profile within a bore of the subsea wellhead member and a released position for releasing from the profile;

an offset arm on the tool body having an elongate side oriented transverse to the axis of the tool body;

a lift arm affixed to the offset arm at a selective distance from the axis of the tool body, the lift arm having an upper end adapted to be secured to a string of pipe; and a fluid passage extending lengthwise through the lift arm and in fluid communication with the fluid passage in the tool body for flowing fluid pumped down the string of pipe into the bore of the subsea wellhead member.

2. The running tool of claim 1, further comprising:

a hydraulic fluid pressure system for moving the latch between the engaged and released positions;

a hydraulic stab receptacle mounted to the running tool for receiving hydraulic fluid pressure from a remotely operated vehicle (ROV) to operate the hydraulic fluid pressure system.

3. The running tool of claim 2, further comprising:

a lock valve assembly in fluid communication with the stab receptacle and having a fitting for manual manipulation by the ROV; and a release valve assembly in fluid communication with the stab receptacle and having a fitting for manual manipulation by the ROV.

4. The running tool of claim 1, further comprising a plurality of weights selectively mounted on the lift arm offset from the axis of the body and offset from an axis of the lift arm to provide balancing of the running tool.

5. The running tool of claim 1, wherein the outlet of the fluid passage in the body comprises a plurality of flow nozzles.

6. The running tool of claim 1, wherein the fluid passage in the lift arm communicates with the fluid passage in the body via an external fluid line extending between the lift arm and the body.

7. The running tool of claim 1, wherein:

the offset arm extends on both sides of the axis of the tool body; and bolt holes are formed through the offset arm on both sides of the axis of the tool body for selectively attaching the lift arm to the offset arm.

8. A running tool for subsea attachment to a subsea wellhead member, the tool comprising:

a tool body configured for insertion into a main bore of the subsea wellhead member, the tool body having an axis aligned with an axis of the bore;

a hydraulically actuated subsea wellhead member latching device attached to the tool body for engaging a mating profile in a body of the subsea wellhead member, the latching device being outwardly movable relative to the tool body to an engaged position and inwardly movable relative to the tool body to a released position;

a hot stab receptacle mounted to the running tool for engagement by a remote operated vehicle (ROV) to supply hydraulic fluid pressure for moving the latching device between the engaged and released positions;

an elongate offset member attached to the tool body and oriented so than an elongate side of the offset member is substantially perpendicular to the tool body axis;

a lift arm mechanically coupled to the offset member selectively positioned along the elongate side of the member based on the center of gravity of the running tool and the subsea wellhead member, the lift arm having a threaded upper end for connection to a string of pipe;

a fluid passage extending lengthwise through the lift arm for receiving fluid pumped down the string of pipe;

a fluid passage extending axially through the body and having an outlet in a lower portion of the body; and an external fluid line connecting the fluid passage in the lift arm with the fluid passage in the body for conveying fluid pumped down the string of pipe to the outlet.

9. The running tool of claim 8, further comprising:

a lock valve assembly in fluid communication with the stab receptacle and having a fitting for manual manipulation by the ROV; and a release valve assembly in fluid communication with the stab receptacle and having fitting for manual manipulation by the ROV.

10. The running tool of claim 8, further comprising:

a plurality of weights selectively mounted on the lift arm offset from the axis of the body and offset from an axis of the lift arm to provide balancing of the running tool.

11. The running tool of claim 8, wherein the outlet of the fluid passage in the body comprises a plurality of flow nozzles.

12. The running tool of claim 8, wherein the offset arm extends on both sides of the axis of the tool body; and the lift arm is selectively attachable to the offset arm on both sides of the axis of the tool body.

13. A method of handling a subsea wellhead member comprising:

providing a running tool having a body with an axis, a wellhead member latch on the body, fluid passage in the body with a fluid outlet on the body below the latch, an elongated offset arm attached to the body in an orientation transverse to the axis of the body, and a lift arm attached to the offset arm, the lift arm having a fluid passage therein in fluid communication with the fluid passage in the body;

selectively positioning the lift arm at a location on the offset arm offset from the axis of the body;

attaching the running tool to the subsea wellhead member by inserting at least a portion of the body into a bore of the wellhead member and actuating the latch;

connecting a string of pipe to the lift arm and lowering the running tool and wellhead member onto a subsea well assembly;

connecting the wellhead member to the subsea well assembly; and pumping fluid down the string of pipe, through the passages in the lift arm and the body and out the outlet into the wellhead member.

14. The method of claim 13, wherein pumping fluid down the string of pipe comprises pressure testing the subsea wellhead member.

15. The method of claim 13, wherein the wellhead member latch comprises a locking member configured for mating attachment with a profile in the bore of the wellhead member, the locking member hydraulically extendable from the tool body and wherein the step of attaching the running tool comprises hydraulically activating the locking member to extend from the tool body into mating attachment with the profile.

16. The method of claim 15 further comprising deploying a remotely operated vehicle (ROV) proximate to the running tool and applying pressurized hydraulic fluid to the running tool from the ROV for activating the wellhead member latch.

17. The method of claim 13, further comprises mounting weights to the running tool offset from an axis of the lift arm to coincide the lift arm axis with the center of gravity of the combined running tool and subsea wellhead member.

18. The method of claim 13, wherein pumping fluid down the string of pipe is performed before connecting the running tool to the subsea wellhead member to clear debris from the subsea wellhead member.

* * * * *

UNITED STATES PATENT AND TRADEMARK OFFICE

CERTIFICATE OF CORRECTION

PATENT NO. : 8,056,634 B2
APPLICATION NO. : 12/102507
DATED : November 15, 2011
INVENTOR(S) : David N. Spencer It is certified that error appears in the above-identified patent and that said Letters Patent is hereby corrected as shown below:

First Page of Patent:

after "(76) Inventor: David N. Spencer, Aberdeen (GB)," please insert:

--(73) Assignee: Vetco Gray Inc., Houston, TX (US)--

Signed and Sealed this
Sixth Day of November, 2012

David J. Kappos

David J. Kappos
*Director of the United States Patent and Trademark Office*